US008937577B2

(12) United States Patent
Neto et al.

(10) Patent No.: US 8,937,577 B2
(45) Date of Patent: Jan. 20, 2015

(54) SUBSTRATE LENS ANTENNA DEVICE

(75) Inventors: Andrea Neto, Voorburg (NL); Giampiero Gerini, Den Haag (NL)

(73) Assignee: Nederlandse Organisatie Voor Toegepast-Natuurwetenschappelijk Onderzoek Tno, Delft (NL)

( * ) Notice: Subject to any disclaimer, the term of this patent is extended or adjusted under 35 U.S.C. 154(b) by 800 days.

(21) Appl. No.: 13/123,907

(22) PCT Filed: Oct. 13, 2009

(86) PCT No.: PCT/NL2009/050618

§ 371 (c)(1), (2), (4) Date: Dec. 5, 2011

(87) PCT Pub. No.: WO2010/044663

PCT Pub. Date: Apr. 22, 2010

(65) Prior Publication Data

US 2012/0088459 A1 Apr. 12, 2012

(30) Foreign Application Priority Data

Oct. 13, 2008 (EP) ..... 08166492

(51) Int. Cl.
*H01Q 19/06* (2006.01)
*H01Q 1/38* (2006.01)
*H01Q 13/20* (2006.01)

(52) U.S. Cl.
CPC ..... *H01Q 19/062* (2013.01); *H01Q 1/38* (2013.01); *H01Q 13/206* (2013.01)
USPC ..... 343/753; 343/783; 343/833

(58) Field of Classification Search
USPC ..... 343/753, 783, 833, 909
See application file for complete search history.

(56) References Cited

U.S. PATENT DOCUMENTS 4,488,156 A * 12/1984 DuFort et al. ..... 343/754
5,706,017 A * 1/1998 Buttgenbach ..... 343/753

(Continued)

FOREIGN PATENT DOCUMENTS

EP 1 619 753 A1 1/2006
EP 1 619 754 A1 1/2006

(Continued)

OTHER PUBLICATIONS

Bruni et al., "The Ultrawideband Leaky Lens Antenna," IEEE Transactions on Antennas and Propagation, 55 (10):2642-2653 (2007).

(Continued)

*Primary Examiner* — Ahshik Kim
(74) *Attorney, Agent, or Firm* — Novak Druce Connolly Bove + Quigg *LLP*

(57) ABSTRACT

A device with a substrate lens antenna uses a lens shaped dielectric body located on top of a planar feed antenna. A leaky wave antenna structure is used as feed antenna. The leaky wave antenna structure has a feed input and a first and second wave propagation branch extending from the feed input. The lens shaped dielectric body has a plane surface containing a focal point of the lens shaped dielectric body, the plane surface located adjacent the first plane, with the focal point adjacent the position of the feed input. Preferably the lens shaped dielectric body is spaced from the leaky wave structure at a sufficient distance to remove most of the propagation speed reduction effect of the dielectric on wave propagation along the leaky wave antenna. This helps to suppress undesirable side-lobes.

16 Claims, 3 Drawing Sheets

(56) References Cited

U.S. PATENT DOCUMENTS

| | | | | |
|---|---|---|---|---|
| 2009/0207095 | A1* | 8/2009 | Kimura et al. | 343/911 L |
| 2010/0033389 | A1* | 2/2010 | Yonak et al. | 343/755 |

FOREIGN PATENT DOCUMENTS

| | | | |
|---|---|---|---|
| WO | 00/76028 | A1 | 12/2000 |
| WO | 2006/009432 | A1 | 1/2006 |

OTHER PUBLICATIONS

Neto et al., "The Leaky Lens: A Broad-Band Fixed-Beam Leaky-Wave Antenna," IEEE Transactions on Antennas and Propagation, 53(10):3240-3246 (2005).

Smith et al., "Subpicosecond Photoconducting Dipole Antennas," IEEE Journal of Quauntum Electronics, 24 (2):255-260 (1988).

van der Vorst et al., "Effect of Internal Reflections on the Radiation Properties and Input Impedance of Integrated Lens Antennas—Comparison Between Theory and Measurements," IEEE Transactions on Microwave Theory and Techniques, 49(6):1118-1125 (2001).

Wu et al., "Design and Characterization of Single- and Multiple-Beam MM-Wave Circularly Polarized Substrate Lens Antennas for Wireless Communications," IEEE Transactions on Microwave Theory and Techniques, 49(3):431-441 (2001).

Neto et al., "Green's Function for an Infinite Slot Printed Between Two Homogeneous Dielectrics—Part I: Magnetic Currents," IEEE Transactions on Antennas and Propagation, 51(7):1572-1581 (2003).

Neto et al., "Green's Function for an Infinite Slot Printed Between Two Homogeneous Dielectrics—Part II: Uniform Asymptotic Solution," IEEE Transactions on Antennas and Propagation, 52(3):666-676 (2004).

Filipovic et al., "Double-Slot Antennas on Extended Hemispherical and Elliptical Silicon Dielectric Lenses," IEEE Transactions on Microwave Theory and Techniques, 41(10):1738-1749 (1993).

* cited by examiner

SUBSTRATE LENS ANTENNA DEVICE

CROSS-REFERENCE TO RELATED APPLICATIONS

This application is filed under 35 U.S.C. 371 as a U.S. national phase application of PCT/NL2009/050618, having an international filing date of 13 Oct. 2009, which claims the benefit of European Patent Application No. 08166492.2, having a filing date of 13 Oct. 2008, both of which are hereby incorporated by reference.

FIELD OF THE INVENTION

The invention relates to a device comprising a substrate lens antenna and a communication device using such an antenna.

BACKGROUND

A substrate lens antenna basically contains a lens shaped dielectric body placed on an IC or printed circuit board that contains a feed antenna structure. Such an antenna is described for example in an article by X. Wu, G. Eleftheriades, T. Emie van Deventer-Perkins, titled "Design and Characterization of Single and Multiple Beam MM-Wave Circularly Polarized Substrate Lens Antennas for Wireless Communications", and published in IEEE Transactions on Microwave Theory and Techniques, Vol. 49, no. 3, March 2001, pages 431-441.

The feed antenna structure is at a focal point of the lens shaped dielectric body. As a result ray breaking at the surface of the lens shaped dielectric body redirects all rays from the focal point towards directions closer to the optical axis of the lens, so that the antenna pattern from the feed antenna is focussed (narrowed). An ellipsoidal body may be used as lens shaped dielectric body, with the feed structure at one focal point of the ellipsoid and the other focal point in the body above the feed structure, in a direction perpendicular to the plane of the feed antenna.

Ideally, the ellipsoidal body has an outline corresponding to a surface of revolution obtained by rotating an ellipse around the line connecting its focal points, cutting off the body in a plane through the lower focal point and perpendicular to this line and placing this plane on the feed antenna structure. Instead an approximation of such a structure may be used, with a half sphere on a cylinder. In this case the cylinder is used to approximate the part of the ellipsoid between the focal points. Although approximate ellipsoid has less focussing effect than the ideal ellipse, it still provides for focussing.

In known substrate lens antenna slot or dipole feed antennas are used at the focal point of dielectric lens. Typically, such feed antennas have a resonant length somewhere between a quarter wavelength and one wavelength, and the dielectric body of the lens has a diameter of many wavelengths. Thus, the feed structure approximates a point source in the focal point and the lens approximately provides for focussing behaviour according to geometrical optics. However, this selection of size of the feed antenna limits the bandwidth over which it can be used.

Transmission of pulses with extreme bandwidth using elliptical lens antennas has been described for example in an article titled "Subpicosecond Photoconducting Dipole Antennas", by Peter R. Smith, David H. Auston, and Martin C. Nuss and published in the IEEE Journal of quantum electronics, VOL 24. NO 2. February 1988 pages 255-260. This article uses a very short dipole, with a length that is much shorter than the wavelengths involved. Thus, wide bandwidth behaviour is realized, but at the cost of low antenna efficiency.

SUMMARY

It may be desirable to provide for a substrate lens antenna that supports a high bandwidth with good efficiency.

According to various aspects of the disclosure, a lens shaped dielectric body is combined with a leaky wave antenna structure having a feed point and a first and second wave propagation branch extending from the feed point both in a first plane. Thus instead of a short (sub-)resonant antenna that is substantially located entirely at the focal point of the lens shaped dielectric body, branches of a leaky wave structure are provided that extend over a considerable distance in order to provide for leaky wave radiation. In an embodiment the branches extend over at least three wavelengths.

A signal generator and/or a signal receiver that are coupled to the antenna may be configured to feed a signal and/or receive a signal at a frequency with wavelength that is at most one third a length of the branches. The antenna makes it possible to operate the receiver or transmitter over more than an octave bandwidth.

In an embodiment a gap is provided between the leaky wave antenna structure and the plane surface of the lens shaped dielectric body, at least along the branches. The gap provides for increasing a speed of propagation of the electromagnetic waves along the branches. This speed is mainly determined by the dielectric constant in the space near the conductors of the leaky wave structure. The gap preferably has a size to remove a significant part of the propagation speed reduction effect of the dielectric on wave propagation along the leaky wave antenna. The increase speed results in suppression of side lobes, because it leads to a more evenly spread energy density at the surface of the lens, which reduces the probability of constructive interference in sidelobe directions. Preferably the gap height is at least equal to the lateral size of the leaky wave antenna branches.

BRIEF DESCRIPTION OF THE DRAWING

These and other objects and advantageous aspects will become apparent from a description of exemplary embodiments, using the following figures.

DETAILED DESCRIPTION OF EXEMPLARY EMBODIMENTS

Figure 1:
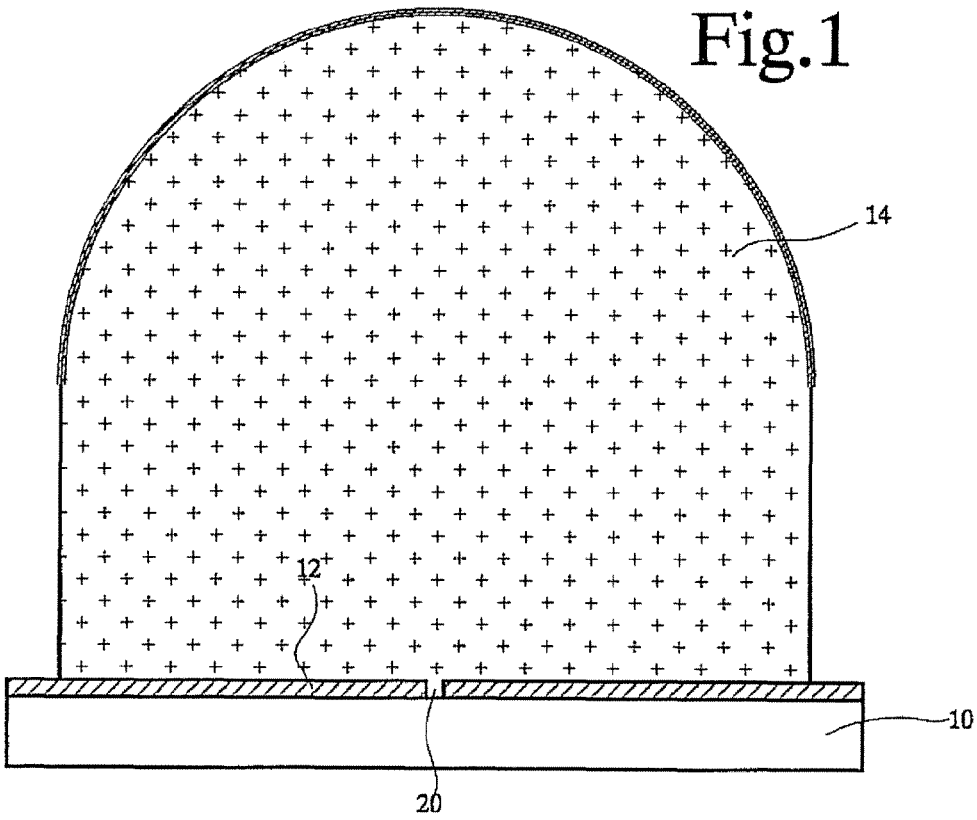
FIG. 1 shows an antenna
Figure 2:
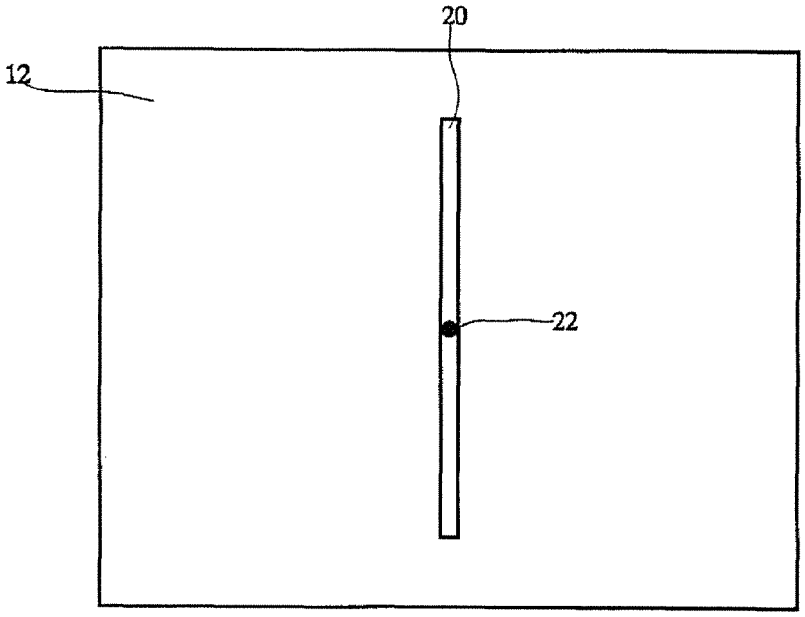
FIG. 2 shows a feed structure

FIG. 1 shows substrate lens antenna in cross section, comprising a substrate 10, a conductor layer 12 on substrate 10 and a lens shaped dielectric body 14 and an electrical conductor layer 12. Conductor layer 12 is intersected by a slot 20. FIG. 2 shows a top view of an embodiment of conductor layer 12. Slot 20 is shown, with a feed 22 at a point in slot 20, the point corresponding to a focal point of lens shaped dielectric body 14. Slot 20 has two branches extending in mutually opposite directions from feed 22. Lens shaped dielectric body 14 is made of a material that has a dielectric constant that is higher than that of air and of substrate 10.

Slot 20 serves as a feed antenna. Although an embodiment is shown with a single slot 20, it should be realized that alternatively other structures may be used as a feed antenna. A pair of parallel slots may be used for example, or a conductor in a dielectric layer instead of conductor layer 12, or a pair of conductors etc.

As may be noted the surface of conductor layer 12 forms a substantially flat plane. This simplifies the construction of the antenna. Lens shaped dielectric body 14 may have any shape. Lens shaped dielectric body 14 may be cylindrically symmetric around an axis through its focal point and perpendicular to electrical conductor layer 12. This also simplifies construction. A surface corresponding to an ellipse with its main axis coinciding with the symmetry axis and rotated around that axis may be used, or an approximation of such a surface, as shown in the figure. More generally, the possible shapes of lens shaped dielectric body 14 may be defined in terms of their refractive effect upon notional rays from the feed point. In one embodiment the lens shape is a focussing lens shape. The shape is said to be focussing lens shaped at least if all notional rays from the feed point refract to a direction closer a focus direction (the direction perpendicular to the upper plane of substrate 10 in the case of the figure). As is well known refraction obeys Snellius's law in terms of the angle of incidence and refracted angle of the notional ray and the ratio of the dielectric constants of lens shaped dielectric body 14 and that of the space outside the body.

For an ideal focussing lens shape, all rays from the feed point refract to rays in the focus direction at the surface of the body. But a non ideal focussing lens shape may be used, wherein all rays merely refract a direction closer a focus direction, or at least when this applies to rays over a range of directions wherein a majority of the radiated power is radiated, in the case of use in transmission. Thus, the shape should avoid refracting rays from the fee point away from the focus direction, except possibly at points where little ray intensity occurs. Typically, a notional hemispherical surface with its origin at the feed point can be used to define a boundary between surface that have this refractive property and surface that do no have this property. Convex surfaces that slope down more rapidly than the sphere at directions away from the apex direction of the sphere have the required refractive effect.

Instead of an ellipsoidal dielectric body 14, a dielectric body 14 with the shape of a half sphere on top of a cylinder may be used, or a half-ellipsoid on top of a cylinder. Preferably, the cylinder and the half sphere or half ellipsoid of such bodies 14 have corresponding cross-sections where the cylinder meets the half sphere or half ellipsoid. In a further embodiment the lens shaped dielectric body 14 may have the shape of a half sphere only, i.e. without a dielectric cylinder between it and substrate 10. As in this embodiment the radiated leaky waves reach the surface of such a half sphere perpendicularly to the surface, the radiated waves do not break at the surface, the lens is not a focussing lens. In this way a more omnidirectional pattern may be formed, the half spherical dielectric body serving to enable radiation of the leaky wave from the feed structure, over a very wide bandwidth that can be a plurality of octaves. A generator or receiver may be used to feed or receive signals to or from the antenna at frequencies distributed over such a band of a plurality of octaves, corresponding to non resonant propagation wavelengths that are much smaller (e.g. at least a factor of five smaller) than the fundamental resonance wavelength of the feed structure.

Figure 3:
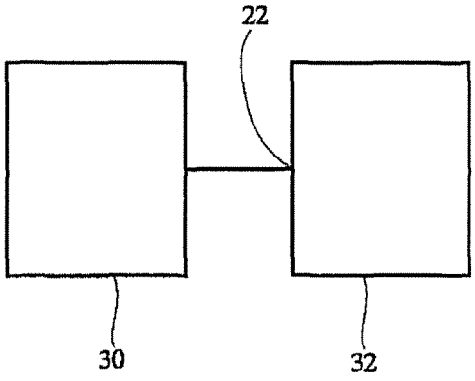
FIG. 3 shows a communication device

FIG. 3 shows a communication device comprising a signal generator 30 and an antenna structure 32 according to FIGS. 1 and 2, with an output of signal generator 30 coupled to feed 22.

Slot 20 serves as a leaky wave antenna structure. In operation, slot 20 supports excitation of waves at feed 22 by means of the signal from signal generator 30 and propagation of the wave along slot 20 along the two branches of slot 20 in two directions from feed 22. Slot 20 has a length that equal to at least three wavelengths of waves propagating along slot 20. Lens shaped dielectric body 14 has a diameter that larger than six wavelengths and preferably much larger, for example fifty wavelengths.

During propagation along the slot, power from the wave leaks out into lens shaped dielectric body 14. The wave-front direction of this leaking radiation is centred along two virtual cones around slot 20. The two cones correspond to the waves in the two directions from the feed point. The cones have an axis along slot 20 and the surfaces of the cones extend at an angle to slot 20 that is determined by the speed of propagation in substrate 10 and lens shaped dielectric body 14.

Because of its focussing effect, lens shaped dielectric body 14 redirects internal radiation with a direction along the cones to external radiation in a direction substantially perpendicular to the plane of conductor layer 12. Thus, both cones result in radiation in substantially the same direction, producing a single beam in that direction. As a result, wave propagation in two directions from the feed point can be used to produce an antenna lobe in one direction, broadside from the surface of conductor layer 12. It may be noted that the cones define the directions of propagation of wave-fronts rather than the direction of rays and that the cones define the direction wherein maximum power wave-fronts occur, rather than lines along which maximum power occurs. However, it has been found that due to the ideal or non-ideal lens shape such wave-fronts will be refracted more closely towards the focus direction everywhere on the wave-front, so that a focussing effect is provided.

The refracted wave-fronts from the two cones (corresponding to the leaky waves in the two directions from the feed point) will interfere constructively in the direction perpendicular to the plane of substrate 10. Thus an antenna lobe with peak sensitivity is created in this direction and lens shaped dielectric body 14 acts to increase the amplitude of the peak.

Figure 4:
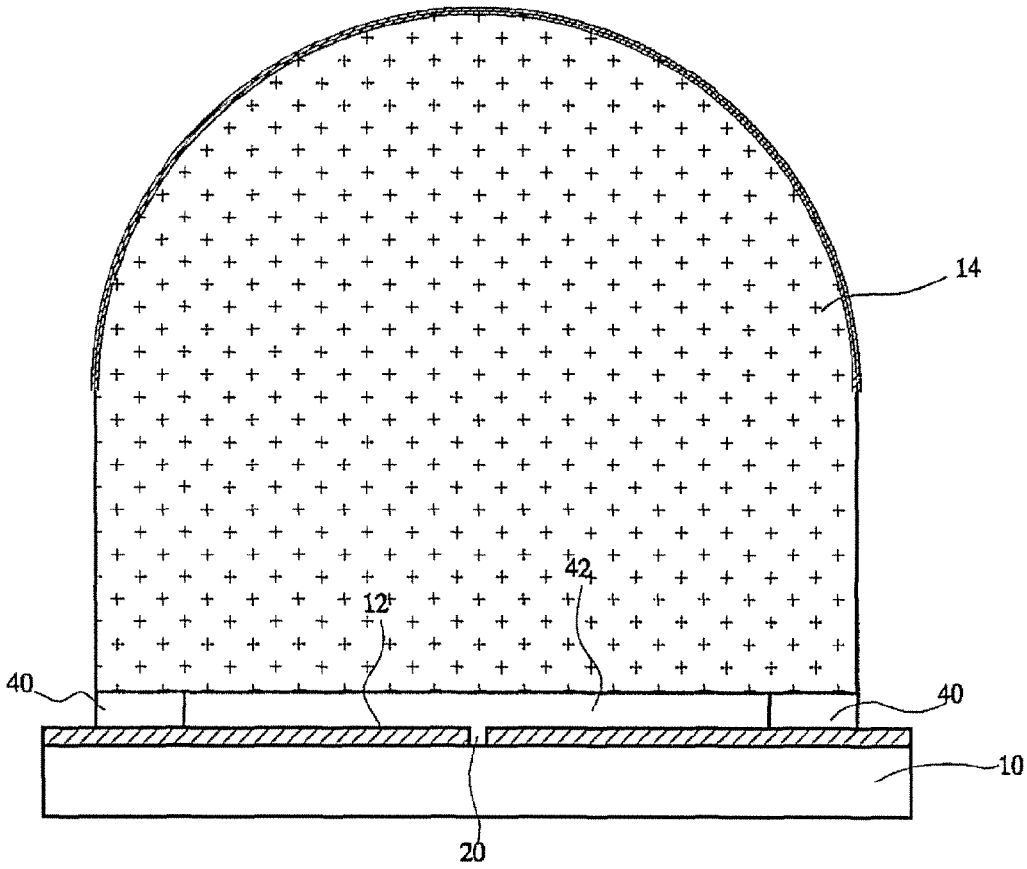
FIG. 4 shows an antenna

FIG. 4 shows a further embodiment of a substrate lens antenna. In this embodiment spacers 40 are provided between the surfaces of conductor layer 12 and lens shaped dielectric body 14 that face each other. Thus, a gap 42 is realized between these surfaces. Gap 42 may be air filled, or vacuum or filled with another gas.

Gap 42 serves to increase the speed of propagation of the waves along slot 20, compared to the situation if FIG. 1 where lens shaped dielectric body 14 is placed directly on conductor layer 12. The increased speed results in increased spread of emerging radiation energy density at the exterior surface of lens shaped dielectric body 14, which reduces side lobes in the antenna pattern. In the situation of FIG. 1 the energy density is concentrated in two areas on opposite sides of lens shaped dielectric body 14. Radiation from these areas interferes constructively in the direction of the main lobe (broadside). But because lens shaped dielectric body 14 has a diameter of many wavelengths, there are also side lobes dues constructive interference at one or more angles relative to the broadside direction. With the increased spread of the energy density due to gap 42, such constructive interferences are reduced, which reduces the side lobes.

The speed of propagation of the waves along slot is determined mainly by the near field of slot 20 (the capacitive field component) rather than the far field (the radiative field component). The speed of propagation is determined by an average of the bulk speed values of the media directly above and below conductor layer 12. By using an air filled gap 42 instead of dielectric material directly above conductor layer 12 the speed is increased. Of course the same holds for any other medium instead of air, or vacuum, wherein the speed of electromagnetic wave propagation is high.

The propagation speed of electromagnetic waves along slot 20 is a function of the height of gap (the distance between conductor layer 12 and lens shaped dielectric body 14). This function may be determined experimentally or by means of model calculations. Most of the increase of the propagation speed occurs for small gap heights up to a height of the same order of magnitude as the transversal size of slot 20. This is because the speed of propagation along slot 20 mainly depends on the properties of the medium in this range of distances to slot 20. The contribution of properties of the medium at larger distances drops of quickly with distance. The same holds for other propagation structures, such as conductor lines, pairs of slots, etc.: if the gap height is at least equal to the lateral features size of the propagation structure (i.e. the width of a slot or slots used in the structure, or the width of a conductor or conductors used in the structure), a significant increase in propagation speed is realized.

The height of the gap is preferably selected at a value where a substantial increase of the propagation speed compared to the absence of a gap (zero height) is realized, that is at least ten percent of the total increase to the value for a gap with infinite height. More preferably, the height of the gap is selected at a value where the increase is at least fifty percent of the total increase. In an embodiment the distance is at least equal to the lateral size of slot 20.

Preferably the height of the gap is kept limited to substantially less than a quarter of the bulk wavelength of the radiated signal in the medium in gap 42. This reduces the effect of reflection off the lower surface of lens shaped dielectric body 14, which effect would reduce the front to back ratio of the antenna. In an embodiment a height of less than a tenth of a wavelength is used. In another embodiment the height of the gap is less than ten times and preferably than twice the lateral size of slot 20. In this way a substantial increase in speed, with the accompanying reduction of the side lobes, can be combined with a high front to back ratio.

Spacers 40 may be protrusions that for an integral part of lens shaped dielectric body 14, or integral protrusions from conductor layer 12, or additional elements inserted between lens shaped dielectric body 14 and conductor layer 12. Although an embodiment is shown wherein the gap extends over most of the surface of conductor layer 12, it suffices that the gap extends laterally to a distance of at least the height of the gap from slot 20 along a majority of the length of slot 20. The presence of a gap at a greater distance has little influence on the speed. Spacers 40 may be located anywhere in gap 42, but it is preferred that they are provided a distance at least a size of slot 20 apart from slot 20, or only at the end or ends of slot 20. Spacers 40 may take the form of a rim around an area that contains conductor layer 12 and slot 20, but any other form of spacing may be used.

Although an example of a gas or vacuum in gap 42 has been shown, it should be realized that alternatively solid or even liquid material may be provided in gap 42, as long as it provides for a material with a higher speed of propagation of electromagnetic waves than of the material of lens shaped dielectric body 14.

In an embodiment signal generator 30 is a wide band signal generator, configured to apply signals at frequencies over at least an octave bandwidth to feed 22 and preferably a plurality of octaves bandwidth. Because a leaky wave structure is used as a feed the antenna it is possible to realize a substrate lens antenna that operates efficiently over such a broad frequency range. Transmission at these frequencies may be realized by switching between different frequency channels within this bandwidth, or by simultaneously using a plurality of channels at a mutual distance distributed within the bandwidth, or by using wideband modulation techniques etc.

Where the present specification speaks of wavelengths to define a minimum or maximum size, for the gap size or length of the feed antenna or size of lens shaped dielectric body 14 or other dimensions, the wavelength of the highest frequency channel used by signal generator 30 is intended for maximum sizes and the wavelength of the lowest frequency channel used by signal generator 30 is intended for minimum sizes.

Although an embodiment with a signal generator 30 has been shown, it should be appreciated that signal generator 30 may be replaced by a signal receiver. In view of reciprocity, the reception and transmission antenna pattern are the same, so that the substrate lens antenna also realized a broadband reception antenna. In this embodiment the signal receiver may configured to receive signals at frequencies over at least an octave bandwidth from feed 22 and preferably a plurality of octaves bandwidth. Reception at these frequencies may be realized by tuning the signal receiver successively to different frequencies in this bandwidth, or by simultaneously receiving a plurality of signals at a mutual frequency distance corresponding to the bandwidth, or by using wideband demodulation techniques etc.

In a further embodiment a transceiver device may be realized by coupling both a signal generator 30 and signal receiver to feed 22. This signal generator 30 and signal receiver may be configured to operate simultaneously or successively at transmission and reception frequencies that are at least an octave bandwidth apart from each other, and in a further embodiment a plurality of bandwidths apart. Also each of the signal generator 30 and signal receiver may operate at a plurality of frequencies at such a bandwidth.

The lateral dimension of slot 20 (its width) and the thickness of conductor layer 12 are preferably substantially smaller than the wavelength of the electromagnetic radiation propagating along slot 20. This keeps the bandwidth high.

Figure 5:
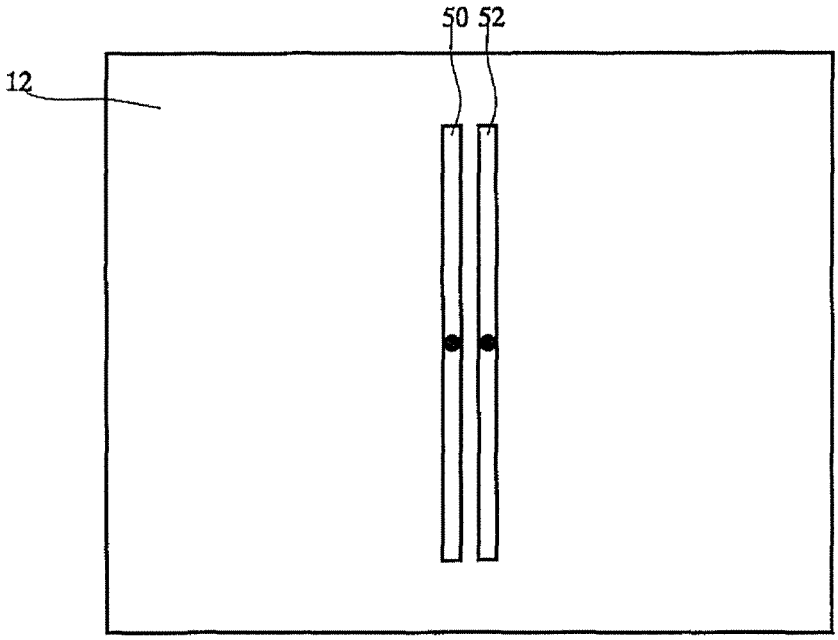
FIG. 5 shows a feed structure

Although an embodiment has been shown wherein the feed antenna is a single slot, it should be appreciated that other leaky wave type feed antennas may be used. FIG. 5 shows an embodiment wherein a pair of slots 50, 52 is used as a leaky wave type feed antenna. In this case, when a gap 42 is used, the size of gap 42 is preferably at least equal to a distance between the slots 50, 52 plus a lateral dimension of the slots 50, 52. Similarly, other types of feed antenna may be used, for example a single conductor track or a pair of parallel conductor tracks. To realize a large bandwidth the distance between slots 50 and 52 is preferably substantially less than the maximum wavelength. In each embodiment the lateral dimension of the feed antenna is preferably substantially smaller than the wavelength of the electromagnetic radiation propagating along the length of the leaky wave antenna structure. This keeps the bandwidth high.

Although an embodiment has been described wherein focussing perpendicular to the plane of the feed antenna is used, it should be appreciated that focussing in other directions is possible. For example, an ellipsoid shaped lens focussed in the direction of the axis through its focal points. By using an ellipsoid that is cut-off through tilted plane through its focal point at a non-perpendicular angle to this axis, a lens may be realized that focuses in a tilted direction.

Although an embodiment has been described wherein two wave propagation structures (e.g. slots) extend in mutually opposite directions from the feed point, it should be realized that a greater number of wave propagation structures (e.g. slots) may be used extending starwise from the feed point. Also two wave propagation structures may be used that extend at an angle to each other, rather than in mutually opposite directions. When the lens shaped dielectric body is rotationally symmetric, its focussing effect does not depend on the direction component of the leaky wave in the plane of the feed structure.

What is claimed is:

1. A device comprising a substrate lens antenna, the device comprising:

a leaky wave antenna structure having a feed point and a first and second wave propagation branch extending from the feed point in mutually different directions in a first plane;

a lens shaped dielectric body having a plane surface containing a focal point of the lens shaped dielectric body, the plane surface located adjacent the first plane, with the focal point adjacent the feed point; and a spacer between the leaky wave antenna structure and the lens shaped dielectric body, the spacer providing for a gap between the leaky wave antenna structure and the plane surface of the lens shaped dielectric body, at least along the first and second wave propagation branches, the gap increasing a speed of propagation of the electromagnetic waves along the first and second wave propagation branches.

2. A device according to claim 1, wherein the first and second wave propagation branch have a length of at least three wavelengths of electromagnetic radiation propagating along the branches for transmission and/or reception by the substrate lens antenna.

3. A device according to claim 2, wherein the gap provides for a distance between the leaky wave antenna structure and the plane surface of the lens shaped dielectric body that is at least equal to a lateral feature size of the branches.

4. A device according to claim 3, wherein said distance is less than ten times the lateral feature size.

5. A device according to claim 4, comprising a signal generator and/or a signal receiver configured to feed a signal to the feed point and/or to receive a signal from the feed point, the signal generator and/or a signal receiver being configured to feed and/or receive the signal at a frequency corresponding to a wavelength of electromagnetic radiation propagating along the branches that is at most one third a length of the branches.

6. A device according to claim 5, wherein the signal generator and/or a signal receiver are configured to feed and/or receive the signal at frequencies separated by at least an octave bandwidth.

7. A method of receiving and or transmitting signals with frequencies spread over a wide band, the method comprising:

providing for leaky wave propagation along branches of a leaky wave antenna structure in a first plane; and focussing and/or inverse focussing radiation to and/or from both branches using a lens shaped dielectric body with a focal point adjacent a feed point between the branches, wherein a leaky wave propagates along the branches through a gap between the leaky wave antenna structure and the lens shaped dielectric body, the gap increasing a speed of propagation of electromagnetic waves along the branches.

8. A method according to claim 7, comprising operating the antenna with frequencies spread over at least an octave bandwidth.

9. A device according to claim 1, wherein the first and second wave propagation branch have a length of at least three wavelengths of electromagnetic radiation propagating along the branches for transmission and/or reception by the substrate lens antenna.

10. A device according to claim 9, wherein the gap provides for a distance between the leaky wave antenna structure and the plane surface of the lens shaped dielectric body that is at least equal to a lateral feature size of the branches.

11. A device according to claim 10, wherein said distance is less than ten times the lateral feature size.

12. A device according to claim 11 comprising a signal generator and/or a signal receiver configured to feed a signal to the feed point and/or to receive a signal from the feed point, the signal generator and/or a signal receiver being configured to feed and/or receive the signal at a frequency corresponding to a wavelength of electromagnetic radiation propagating along the branches that is at most one third a length of the branches.

13. A device according to claim 1, comprising a signal generator and/or a signal receiver configured to feed a signal to the feed point and/or to receive a signal from the feed point, the signal generator and/or a signal receiver being configured to feed and/or receive the signal at a frequency corresponding to a wavelength of electromagnetic radiation propagating along the branches that is at most one third a length of the branches.

14. A device according to claim 1, comprising a signal generator and/or a signal receiver configured to feed a signal to the feed point and/or to receive a signal from the feed point, the signal generator and/or a signal receiver being configured to feed and/or receive the signal at a frequency corresponding to a wavelength of electromagnetic radiation propagating along the branches that is at most one third a length of the branches.

15. A device according to claim 2, comprising a signal generator and/or a signal receiver configured to feed a signal to the feed point and/or to receive a signal from the feed point, the signal generator and/or a signal receiver being configured to feed and/or receive the signal at a frequency corresponding to a wavelength of electromagnetic radiation propagating along the branches that is at most one third a length of the branches.

16. A device according to claim 3, comprising a signal generator and/or a signal receiver configured to feed a signal to the feed point and/or to receive a signal from the feed point, the signal generator and/or a signal receiver being configured to feed and/or receive the signal at a frequency corresponding to a wavelength of electromagnetic radiation propagating along the branches that is at most one third a length of the branches.

* * * * *